US006686523B1

(12) United States Patent
Devereaux et al.

(10) Patent No.: US 6,686,523 B1
(45) Date of Patent: Feb. 3, 2004

(54) SYSTEM AND METHOD FOR MOUNTING INSTRUMENT COMPONENTS

(76) Inventors: Sharon Devereaux, 9608 Morris Hunter Dr., Oakdale, CA (US) 95361; Kurt O. Laubhan, 710 Columbia Way, Modesto, CA (US) 95350

( * ) Notice: Subject to any disclaimer, the term of this patent is extended or adjusted under 35 U.S.C. 154(b) by 114 days.

(21) Appl. No.: 10/051,684

(22) Filed: Jan. 16, 2002

Related U.S. Application Data

(60) Provisional application No. 60/262,439, filed on Jan. 16, 2001.

(51) Int. Cl.[7] ..... G10D 3/80
(52) U.S. Cl. ..... 84/297; 84/290
(58) Field of Search ..... 411/395, 366.1; 821/299, 289, 290, 307

(56) References Cited

U.S. PATENT DOCUMENTS

| | | | | |
|---|---|---|---|---|
| 1,365,839 A | | 1/1921 | McHugh et al. | |
| 2,714,326 A | | 8/1955 | McCarty | |
| 2,740,313 A | | 4/1956 | McCarty | |
| 3,237,502 A | | 3/1966 | Moseley | |
| 3,440,921 A | | 4/1969 | McCarty | |
| 3,876,821 A | * | 4/1975 | Pringle | 174/53 |
| 4,069,733 A | | 1/1978 | Quan | |
| 4,291,607 A | | 9/1981 | Kauffman | |
| 4,457,201 A | | 7/1984 | Storey | |
| 4,753,560 A | * | 6/1988 | Ryder | 411/82 |
| 5,231,908 A | * | 8/1993 | Skvarce et al. | 83/699.11 |
| 5,497,690 A | | 3/1996 | Soupios | |
| 5,716,112 A | * | 2/1998 | Staszak | 305/180 |
| 6,028,258 A | * | 2/2000 | Hicks et al. | 84/421 |
| 6,599,071 B1 | * | 7/2003 | McCauley et al. | 411/378 |

* cited by examiner

*Primary Examiner*—Kimberly Lockett
(74) *Attorney, Agent, or Firm*—Carr & Ferrell LLP

(57) ABSTRACT

An improved system and method for mounting instrument components is provided for use in facilitating the tuning and retuning procedure of string instruments. The improved system includes a component having a stud aperture at each end and a mounting apparatus. The mounting apparatus further includes a mounting stud and an insert having a plate, an aperture portion, and a threaded bottom portion. The threaded bottom portion is removably fastened into the instrument. Subsequently, the component is positioned such that the stud aperture is located over the plate. Next, the mounting stud is fastened into the aperture portion of the insert such that the mounting stud clamps down on the component. In a further embodiment, adjustment screws may be utilized to laterally position the component relative to the insert and the mounting stud.

20 Claims, 5 Drawing Sheets

SYSTEM AND METHOD FOR MOUNTING INSTRUMENT COMPONENTS

CROSS-REFERENCES TO RELATED APPLICATIONS

This application claims the benefit of Provisional Patent Application Serial No. 60/262,439, filed on Jan.16, 2001, entitled "Improved System and Method for Mounting Guitar Components," which is incorporated herein by reference. This application is also related to U.S. patent application Ser. No. 09/697,529, filed Oct. 25, 2000, and entitled "Guitar Bridge and Tailpiece", which is herein incorporated by reference.

BACKGROUND OF THE INVENTION

1. Field of the Invention

This invention relates to instrument components and more particularly to an improved system and method for mounting instrument components to a stringed instrument.

2. Description of Related Art

Generally, stringed instruments such as guitars have separate structures, which must be carefully installed and aligned in order for the strings to accurately reproduce desired notes when the strings are plucked or strummed. Referring to FIG. 1A and FIG. 1B, components of a standard guitar are shown mounted to a guitar body 100. These components include a tailpiece 102, a bridge 104, and pickups 106. Using a conventional method of mounting guitar components, the tailpiece 102 and the bridge 104 are typically held in position by tension from strings 108, 109, 110, 111, 112, and 113 (herein after "108–113"). At one end, the strings 108–113 pass through holes in the tailpiece 102. The tailpiece 102 provides mechanical strength for the tension of the stretched strings 108–113 against the guitar body. The strings 108–113 then pass over the bridge 106, which is used to initially set the tuning of the guitar to a proper tone and timbre.

In a typical electric guitar, the strings 108–113 will next pass over one or more magnetic or other type of pickups 106. These pickups 106 convert the physical vibration of the strings 108–113 into electrical energy, which can then be electrically amplified. The strings 108–113 then extend over, but do not contact, multiple frets (not shown) on the guitar body 100, between which the strings 108–113 are depressed so that the effective length of the strings 108–113 are shortened. This shortening of the strings 108–113 thereby increases a frequency at which a particular string vibrates, thus causing a distinct note.

The strings 108–113 eventually extend onto tuning pegs (not shown) towards a neck of the guitar body 100. These tuning pegs are adjustable to increase and decrease the tension on the strings 108–113. A change in tension of the strings 108–113 causes a change in the frequency of the tone of each string so that the proper notes are heard.

Accordingly, the strings 108–113 are stretched initially between the bridge 104 and the tuning peg in order to tune the strings 108–113 to their proper respective note. Then the strings 108–113 are stressed further by a guitar player while playing by forcing the strings 108–113 down onto the a fingerboard between the frets. Because the energy with which some players play their guitars, the strings 108–113 stretch and may have to be replaced daily or even more frequently. Conventionally, the tailpiece 102 and the bridge 104 are only held in position by tension from the strings 108–113. Thus, loosening or removal of the strings 108–113 will cause the tailpiece 102 and the bridge 104 to become freely detached from the guitar body 100. If the guitar turner is not careful, the tailpiece 102 or the bridge 104 may accidentally fall off the guitar body 100 and possibly mar a surface of the guitar body 100.

A further disadvantage of conventional methods of securing tailpieces and bridges is that a complete readjustment of all components of the guitar is typically required after every loosening and/or removal of the strings 108–113. Thus, readjustment may be required after such simple operations as cleaning and simple maintenance of the guitar. Retuning requires a very fine ear and patience from a guitar tuner. Alternatively, the guitar tuner may utilize a separate tuning device to reset the guitar bridge 104 and tuning ramps known as saddles on the bridge 102. With either retuning method, much time and effort is required to retune the guitar to a playable condition. Therefore, there is a need for an improved system and method for securing instrument components to stringed instruments.

SUMMARY OF THE INVENTION

The present invention provides an improved system and method for securing a component to an instrument body. The system includes a component having a long, narrow base piece with a vertical stud aperture at each end of the base piece formed from a top surface through a bottom surface of the component. The system further includes a mounting apparatus having an insert, which is removably mounted into the instrument body. The component may further include an adjustment screw hole extending from one side of the component to each stud aperture. Adjustment screws may then be provided for insertion into the adjustment screw holes. The adjustment screws are fastened through the adjustment screw holes and into contact with the insert to position the component laterally with respect to the insert.

The mounting apparatus further includes a mounting stud, which secures the component to the instrument body. The mounting stud comprises a top portion and a threaded lower portion. The component is positioned such that the component is supported on a plate of the insert. The mounting stud is fastened into an aperture portion of the insert such that the top portion of the mounting stud clamps down on the component and securely holds the component in place.

Thus, the present invention allows for critical adjustments and settings to be made and preserved by securing the components to the instrument body. The components retain their setting adjustments and remain solidly secured even when strings are completely removed from the instrument. The present invention also improves sound quality and playability of the instrument. By creating a secure solid connection with the instrument body, resonation of the strings are better transferred to the instrument body creating a louder and more full sounding instrument. This system and method of the present invention also increases the sustainability of string vibrations by better transfer of resonation to the instrument body.

DESCRIPTION OF THE PREFERRED EMBODIMENTS

The present system and method relates to an improved mounting device for use in facilitating the restringing procedure for a stringed instrument, and for improving the sound from the stringed instrument by creating a more solidly mounted system for coupling the strings to a resonating instrument body. After the initial tuning of the instrument, such as a guitar, components are secured to the instrument and cannot come loose even when the strings are removed. Further, the present system and method prevents any damage, which may occur from components accidentally detaching from the instrument when strings are loosened or removed. Advantageously, the present system and method removes the need to retune the instrument after each restringing or adjustment of the strings.

Figure 1A:
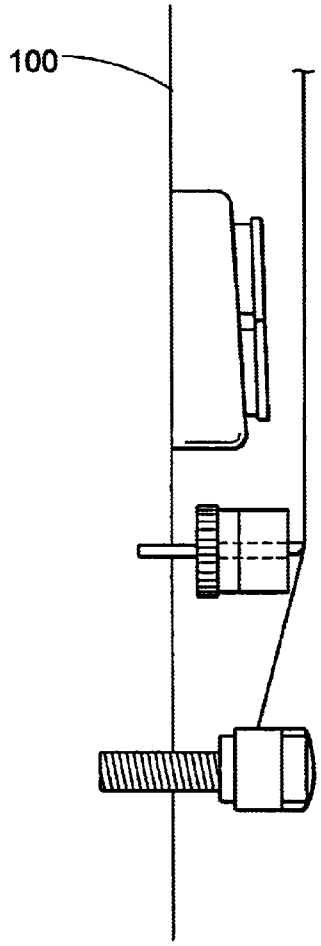
FIG. 1A is a side view of a conventional guitar body and components.
Figure 1B:
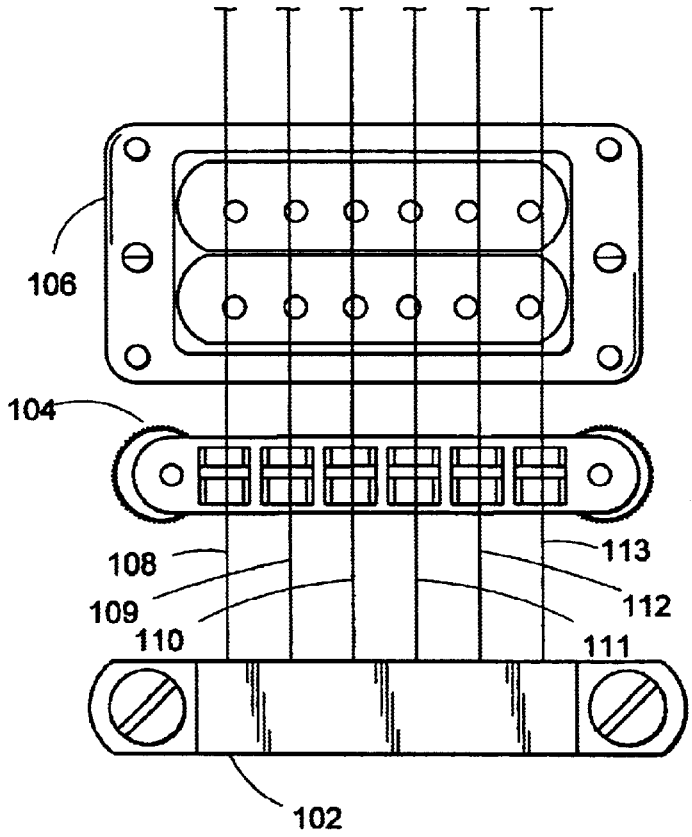
FIG. 1B is a top view of the conventional guitar body and components or FIG. 1A.
Figure 2:
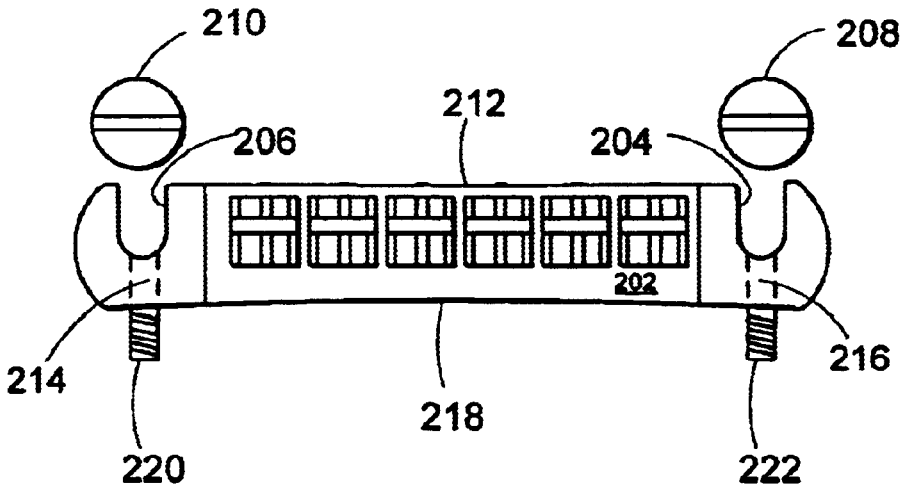
FIG. 2 is a top view of an exemplary combination bridge and tailpiece combination, according to the present invention.

Referring now to FIG. 2, a top view of an exemplary combination bridge and tailpiece component 200 is shown. The component 200 comprises a long, narrow base piece that is preferably formed of a metal, such as steel or brass. A top surface 202 of the component 200 is generally flat, while a bottom surface (not shown) is preferably concaved to match a curvature of the instrument body. Alternatively, the top surface 202 may be curved, the bottom surface may be flat, or any other combination of the top surface 202 and bottom surface may be used depending on the design requirements of the instrument.

Stud apertures 204 and 206 extending from the top surface 204 to the bottom surface are formed towards each end of the component 200 through which mounting studs 208 and 210 may be disposed therein. In the embodiment of FIG. 2, the stud apertures extend to a first side 212 of the component 200 thus forming an open slot, which allows for the component 200 to be laterally adjustable relative to the mounting studs 208 and 210. In an alternative embodiment, the stud apertures 204 and 206 may not extend fully to the first side 212, but form an oval, circular, or other shaped hole.

The component 200 further includes adjustment screw holes 214 and 216. These adjustment screw holes 214 and 216 extend laterally from a second side 218 of the component 200 through the component 200 to the stud apertures 204 and 206. Preferably, the adjustment screw holes 214 and 216 are threaded to accept adjustment screws 220 and 222 which assist in the lateral positioning of the component 200 relative to the mounting studs 208 and 210 as will be described in more detail in connection with FIG. 5.

Figure 3A:
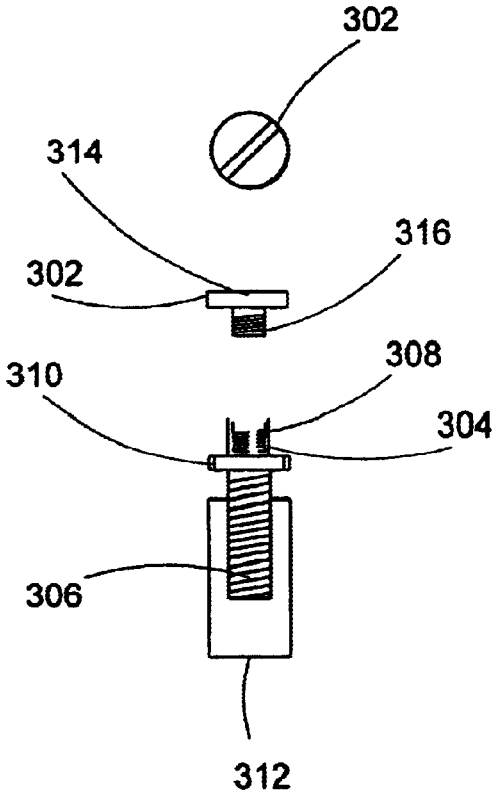
FIG. 3A is a side view of a mounting apparatus including a mounting stud and insert, according to the present invention.

FIG. 3A depicts an exemplary mountingapparatus 300 according to one embodiment of the present invention. The mounting apparatus 300 comprises a mounting stud 302 and an insert 304. The insert 304 further includes a threaded bottom portion 306, an aperture portion 308, and a plate 310 located between the threaded bottom portion 306 and the aperture portion 308. The plate 310 is preferably squared off to accept a wrench. The insert 304 is removably mounted into the instrument body by fastening the threaded bottom portion 306 into a threaded hole or grommet 312. Thus, the height of the mounting apparatus 300 and, subsequently, the component 200 (FIG. 2) may be adjusted simply by rotating the insert 304 up or down via the plate 310 relative to the instrument body. In one embodiment, the insert 304 is fastened into the threaded hole or grommet 312 which may be permanently mounted in the instrument body.

The mounting stud 302 further includes a top portion 314 and a threaded lower portion 316. In one embodiment of the present invention, the top portion 312 is slotted so that a flat-head screwdriver may be utilized for adjusting the height of the mounting stud 302 relative to the insert 304. Alternatively, other fastening systems may be utilized such as a square bit or a hex head.

Figure 3B:
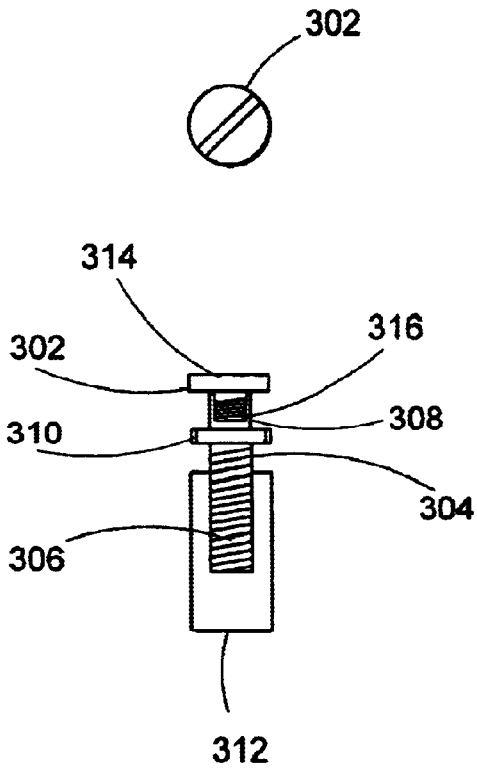
FIG. 3B is a side view of the mounting apparatus of FIG. 3A with the mounting stud fastened in the insert.

Referring now to FIG. 3B, the mounting stud 302 is removably coupled to the insert 304. Specifically, the threaded lower portion 316 of the mounting stud 302 is positioned into the aperture portion 308 of the insert 304. To assist in the fastening process, a wrench may be used to hold the insert 304 stationary via the plate 310 while the mounting stud 302 is rotated into or out of the aperture portion 308.

Figure 4:
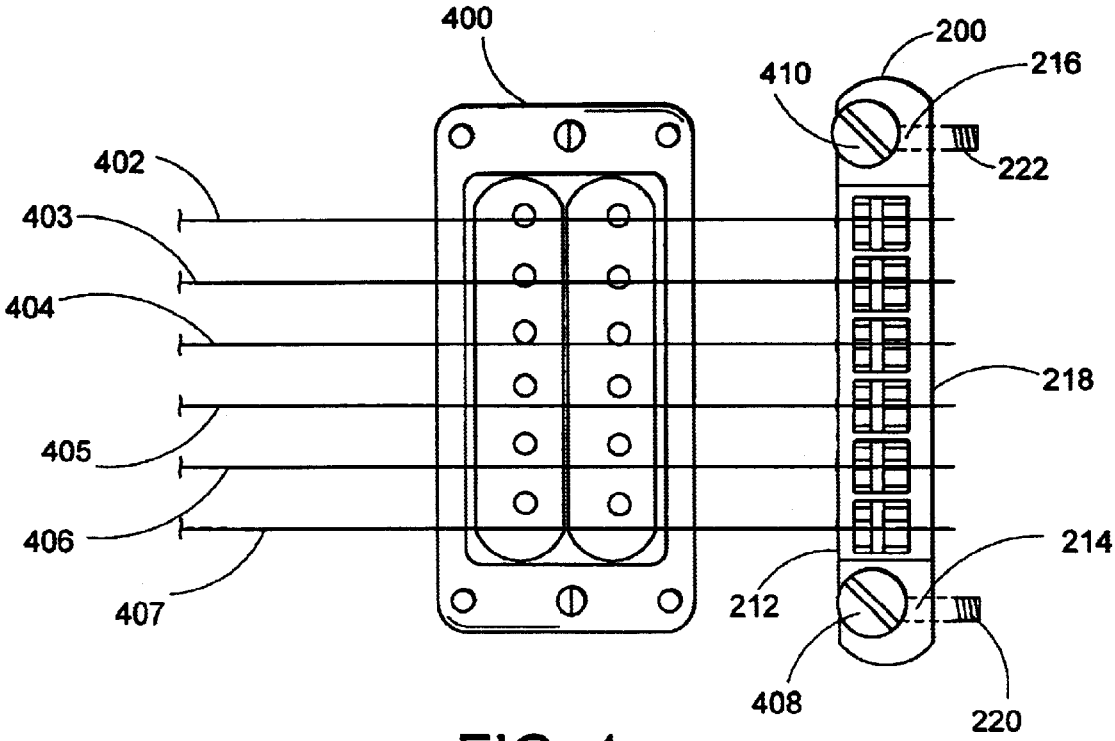
FIG. 4 is a top view of the component of FIG. 2 mounted on a instrument body.

FIG. 4 shows a top view of the exemplary component 200 of FIG. 2 mounted on an instrument body using a mounting apparatus similar to that of FIG. 3A and FIG. 3B. Also shown in FIG. 4 is a pickup 400 over which stings 402, 403, 404, 405, 406, and 407 extend. The component 200 is held in place by mounting studs 408 and 410, which are similar to the mounting stud 302 of FIG. 3.

Figure 5:
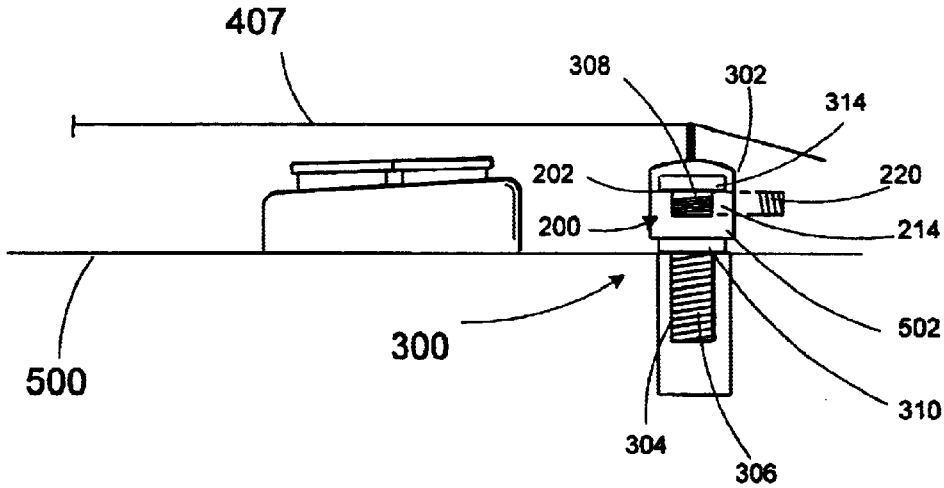
FIG. 5 isa side view of the component of FIG. 4 utilizing the mounting apparatus of FIG. 3A.

FIG. 5 illustrates a side view of the embodiment of FIG. 4 mounted on an instrument body 500. The mounting apparatus will be described using the embodiment of FIG. 3A. Because the slots of the stud apertures 204 and 206 are generally smaller than the diameter of the plate 310, the component 200 will rest on top of the plate 310. Furthermore, the length of the aperture portion 308 of the insert 304 is preferably less than the height of the component 200 between the top surface 204 and a bottom surface 502. Consequently, the fastening of the mounting stud 302 into the aperture portion 308 will fixedly clamp the component 200 in position between the plate 310 and a bottom surface of the top portion 312 of the mounting stud 302. If the height of the component 200 needs to be adjusted, the mounting apparatus 300 may be raised or lowered by rotating the threaded bottom portion 306 of the insert 304 further into or out of the instrument body 500.

Also shown in FIG. 5 is the adjustment screw 220. As previous described, the adjustment screw 220 provides for lateral positioning of the component 200 relative to the insert 304. Thus, rotating the adjustment screw 220 outwardly will position the insert 304, and thus the mounting stud 302, further within the slot of the stud aperture 206 (FIG. 2). Alternatively, advancing the adjustment screw 220 into the adjustment screw hole 214 will position the insert 304 further towards a mouth of the slot of the stud aperture 206. It should be noted that the adjustment screw 220 is not necessary for positioning the insert 304 and the mounting stud 302 relative to the component 200, but helps facilitate the process.

Figure 6A:
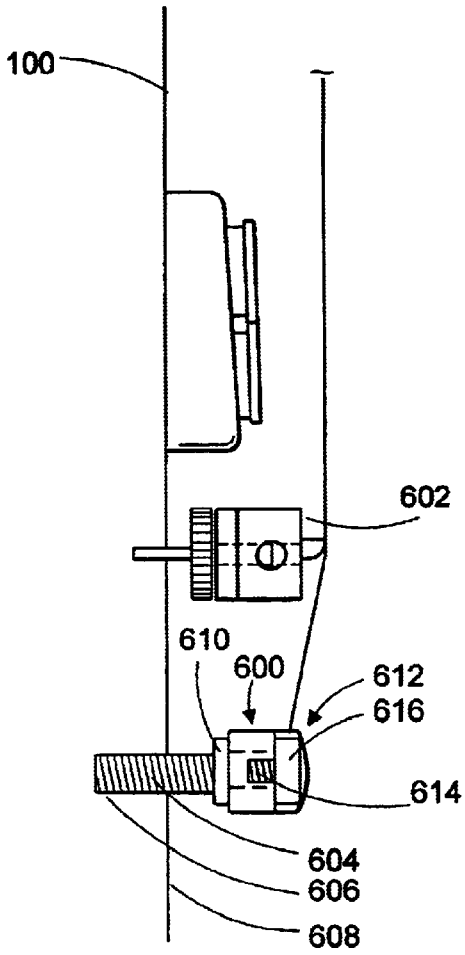
FIG. 6A is a side view of the alternative embodiment of the present invention.
Figure 6B:
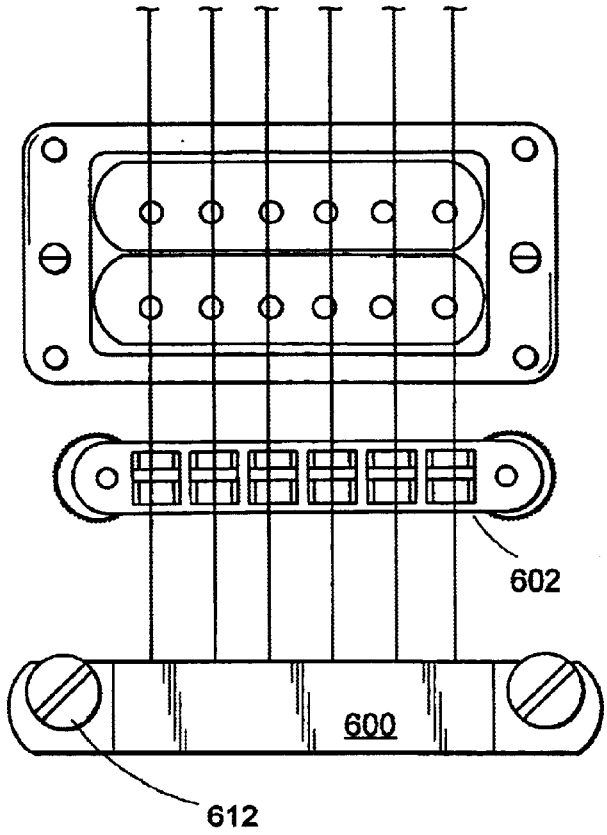
FIG. 6B is a top view of the alternative embodiment of FIG. 6A.

FIG. 6A and FIG. 6B illustrate an alternative instrument component system. In the present embodiment, a tailpiece component 600 is separate from a bridge component 602.

However, the mounting system works in a similar fashion as previously described in connection with FIGS. 2–5. An insert 604 is removably mounted in a hole or grommet 606 of an instrument body 608. The tailpiece component 600 is then positioned such that the tailpiece component 600 rests over a plate 610 of the insert 604. A mounting stud 612 is then fastened into a threaded aperture portion 614 of the insert 604 until a top portion 616 of the mounting stud 612 exerts pressure onto the tailpiece component 600, thus clamping the tailpiece 600 between the top portion 616 and the plate 610. In this embodiment, adjustment screws are not utilized to position the tailpiece component 600 relative to the insert 604 and the mounting stud 612. However, if so desired, adjustment screw holes may be provided in the tailpiece component 600 for this purpose, and adjustment screws utilized for lateral positioning of the tailpiece component 600.

In the embodiment shown in FIG. 6, the bridge component 602 maybe a conventional bridge or an improved bridge as described in U.S. patent application Ser. No. 09/697,529. In yet a further embodiment, the bridge component may be mounted to the instrument body using the mounting system of the present invention.

While the invention has been described with reference to specific embodiments, those skilled in the art will understand that various changes may be made and equivalents may be substituted for elements thereof without departing from the true spirit and scope of the invention. For example, the present system and method may be utilized on both string and non-string instruments for mounting of components to a body of any instrument. Therefore, these and other variations upon the specific embodiments are intended to be covered by the present invention.

What is claimed is:

1. A system for mounting a component to an instrument body comprising:

a component having an stud aperture at each end of the component;

a mounting stud having a top portion and a threaded lower portion, the threaded lower portion being positioned in the stud aperture; and an insert having a plate and an aperture portion, the aperture portion accepting the threaded lower portion of the mounting stud to hold the component in position between the top portion of the mounting stud and the plate of the insert.

2. The system of claim 1 wherein the insert further comprises a bottom portion, the bottom portion allowing the insert to be attached to the instrument body.

3. The system of claim 2 wherein the bottom portion is threaded, the threaded bottom portion allowing the insert to be adjustably attached to the instrument body.

4. The system of claim 1 wherein the component is a combination bridge and tailpiece of a stringed instrument.

5. The system of claim 1 wherein the component is a bridge of a stringed instrument.

6. The system of claim 1 wherein the component is a tailpiece of a stringed instrument.

7. The system of claim 1 wherein the component further comprises an adjustment screw hole at each end of the component, the adjustment screw hole extending from one side of the component to each stud aperture.

8. The system of claim 7 further comprising an adjustment screw, the adjustment screw being positioned in the adjustment screw hole to laterally position the component relative to the insert and the mounting stud.

9. The system of claim 1 wherein the stud aperture comprises a slot extending to one side of the component.

10. The system of claim 1 wherein the plate is square-shaped in order to accept a wrench.

11. A method for mounting a component having stud apertures to an instrument body comprising the steps of:

mounting an insert having a plate into an aperture of the instrument body;

positioning the component over the plate; and fastening a mounting stud into an aperture portion of the insert so as to clamp the component between the plate and the mounting stud.

12. The method of claim 11 wherein the step of positioning further comprises aligning the stud aperture over the plate.

13. The method of claim 11 further comprising the step of adjusting the insert relative to the instrument body to adjust the height of the component relative to the instrument body.

14. The method of claim 11 further comprising the step of laterally adjusting the component by rotating an adjustment screw into or out of an adjustment screw hole.

15. A mounting apparatus for mounting a component to an instrument body comprising:

a mounting stud having a top portion and a lower portion, the lower portion being positioned into a stud aperture of the component; and an insert having a plate and an aperture portion, the aperture portion accepting the lower portion of the mounting stud to hold the component in position between the top portion and the plate.

16. The mounting apparatus of claim 15 wherein the insert further comprises a bottom portion, the bottom portion allowing the insert to be attached to the instrument body.

17. The mounting apparatus of claim 16 wherein the bottom portion is threaded, the threaded bottom portion allowing the insert to be adjustably attached to the instrument body.

18. The mounting apparatus of claim 15 wherein the lower portion of the mounting stud and the aperture portion of the insert is threaded thus allowing the aperture portion to receive the threaded lower portion of the mounting stud.

19. The mounting apparatus of claim 15 wherein the plate is square-shaped in order to accept a wrench.

20. A system for mounting a component to an instrument body comprising:

means for mounting an insert having a plate into an aperture of the instrument body;

means for positioning the component over the plate; and means for fastening a mounting stud into an aperture portion of the insert so as to clamp the component between the plate and the mounting stud.

* * * * *